US005873514A

United States Patent [19]

Brooks

[11] Patent Number: 5,873,514

[45] Date of Patent: Feb. 23, 1999

[54] LINED CARTON OF TRIANGULAR CROSS-SECTION

[76] Inventor: Stephen John Brooks, Coedifan, Cynghordy, Llandovery Dyfed SA20 OLW, United Kingdom

[21] Appl. No.: 875,894

[22] PCT Filed: Feb. 5, 1996

[86] PCT No.: PCT/GB96/00226

§ 371 Date: Jul. 18, 1997

§ 102(e) Date: Jul. 18, 1997

[87] PCT Pub. No.: WO96/23697

PCT Pub. Date: Aug. 8, 1996

[30] Foreign Application Priority Data

Feb. 3, 1995 [GB] United Kingdom ..... 9502148
Jun. 29, 1995 [GB] United Kingdom ..... 9513237

[51] Int. Cl.[6] ..... B65D 5/00

[52] U.S. Cl. ..... 229/115; 229/103.2; 229/160.1; 206/268

[58] Field of Search ..... 229/115, 103.2, 229/160.1, 23 R; 206/268, 273

[56] References Cited

U.S. PATENT DOCUMENTS

| | | | |
|---|---|---|---|
| 1,986,145 | 1/1935 | Goodyear | 229/45 |
| 2,965,280 | 12/1960 | Miller | 229/37 |
| 3,075,683 | 1/1963 | Grossman et al. | 229/14 |
| 3,550,834 | 12/1970 | McCall | 229/115 |
| 3,891,136 | 6/1975 | Woeste | 229/115 |
| 3,929,271 | 12/1975 | Meyers | 229/4.5 |
| 4,121,752 | 10/1978 | Ravotto et al. | 229/115 X |
| 4,216,898 | 8/1980 | Davies | 229/44 |
| 4,251,022 | 2/1981 | Focke | 229/44 CB |
| 4,253,601 | 3/1981 | Kossoff | 229/115 |
| 4,372,476 | 2/1983 | Harned et al. | 229/915 X |
| 4,425,731 | 1/1984 | Orlando | 229/115 X |
| 4,923,059 | 5/1990 | Evers et al. | 206/265 |

FOREIGN PATENT DOCUMENTS

| | | |
|---|---|---|
| 9408308 | 8/1994 | Germany . |
| 4421175 | 1/1995 | Germany . |
| 239738 | 9/1925 | United Kingdom . |
| 277173 | 9/1927 | United Kingdom . |
| 9202424 | 2/1992 | WIPO . |

*Primary Examiner*—Gary E. Elkins
*Assistant Examiner*—Tri Mai
*Attorney, Agent, or Firm*—Edwin D. Schindler

[57] ABSTRACT

A tubular carton or pack is of triangular cross section for carrying, for example, a rolled-up paper product. The carton is formed from a blank which is folded-up to form an inner lining and then an outer shell. Each end is closed by a triangular end piece (24) which is retained in position by retainer flaps (25) which are inserted between the inner lining and outer shell. The carton may have a short end portion arranged to hinge open along a fold line formed across the base side of the carton, to allow easy access to its contents.

12 Claims, 9 Drawing Sheets

LINED CARTON OF TRIANGULAR CROSS-SECTION

This invention relates to a carton or pack which may be used for a wide variety of purposes.

Many cartons have been used hitherto, which are of square or rectangular cross-sectional shape. Circular-section tubular containers have also been commonly used hitherto, particularly for carrying rolled-up maps or drawings for example. Such circular-section tubular containers suffer the disadvantage that it is often difficult to remove the rolled-up product from the container, either because access to the end of the rolled-up product through the end of the tube is difficult, or because the rolled-up product is retained too tightly by friction against the inner surface of the tube.

I have now devised a carton or pack which is easier to use, for carrying rolled-up products, than the conventional tubular container, but which may also be used, suitably dimensioned, to contain other products.

In accordance with this invention, there is provided a carton or pack of triangular cross-section, said carton or pack being formed from a blank of sheet material which is provided with a series of folds dividing the blank into a plurality of panels, the blank being folded up along successive said fold lines to form an inner lining and a triangular section outer shell around said inner lining.

The carton or pack can accordingly be made from a blank of relatively thin sheet material, but achieve high strength.

Preferably at least one end of the blank has a triangular end piece projecting therefrom to close the corresponding end of the carton or blank.

Preferably the or each triangular end piece is retained in a closed position, across the corresponding end of the carton or pack, by retainer flaps hinged to the end piece and inserted between said inner lining and outer shell of the carton or pack. This provides a simple yet effective arrangement for closing the end of the carton whilst avoiding the use of adhesive or other means of retention.

Preferably the carton or pack has an end portion which can be opened by flexing about a fold line extending across a base side of the carton at a position inset from the respective end of the carton.

This carton can be used to contain a rolled-up product without excessive frictional engagement between the product and the inner surfaces of the carton, because the two engage each other only along three discrete lines of contact. Further, by providing an end portion of the carton which can be hinged open, the end of the rolled-up product becomes easily accessible: often, the end of the rolled-up product will extend beyond the end of the main portion of the carton; in any event, there is space at the vertices of the carton for the user to insert his fingers and grip the rolled-up product to withdraw it.

Preferably the two sides of the carton are equal, so that its cross-sectional shape is that of an isosceles triangle. The two sides and the base may all be equal to one another, so that the carton cross-sectional shape is that of an equilateral triangle. Alternatively, the two sides and the base may be tapered such that one end of the carton or pack is wider than the opposite end.

Preferably the inner lining projects beyond the end of the outer shell at the end of the main portion of the carton. Accordingly, the hinged end portion of the carton frictionally engages over the projecting end of the inner lining, when this end portion is closed, to hold the latter in its closed position. Preferably the end of the outer shell inclines from the hinge line to the apex opposite the hinged base, away from the end of the carton.

Also in accordance with this invention, there is provided a carton or pack of triangular cross-section comprising a base and two sides, the carton or pack being formed from a blank which is provided with a series of folds dividing the blank into a plurality of panels, the blank being folded up along successive fold lines, and the carton having an end portion which can be opened by flexing about a fold line extending across said base at a position inset from the end of the carton.

The carton or pack may be formed from a one-piece blank of sheet material, for example card. Instead, the carton or pack may be formed from a blank which comprises two or more pieces of sheet material joined end-to-end. This provides for modular construction, in which the carton can be made to a selected or extended length, by joining in one or more extension pieces between opposite end pieces. This overcomes problems which arise where particularly long articles are to be packaged.

Thus, further in accordance with this invention, there is provided a carton or pack which is formed from a blank of sheet material, said blank comprising two or more pieces of sheet material joined together end-to-end.

Embodiments of this invention will now be described, by way of examples only and with reference to the accompanying drawings, in which.

Figure 1:
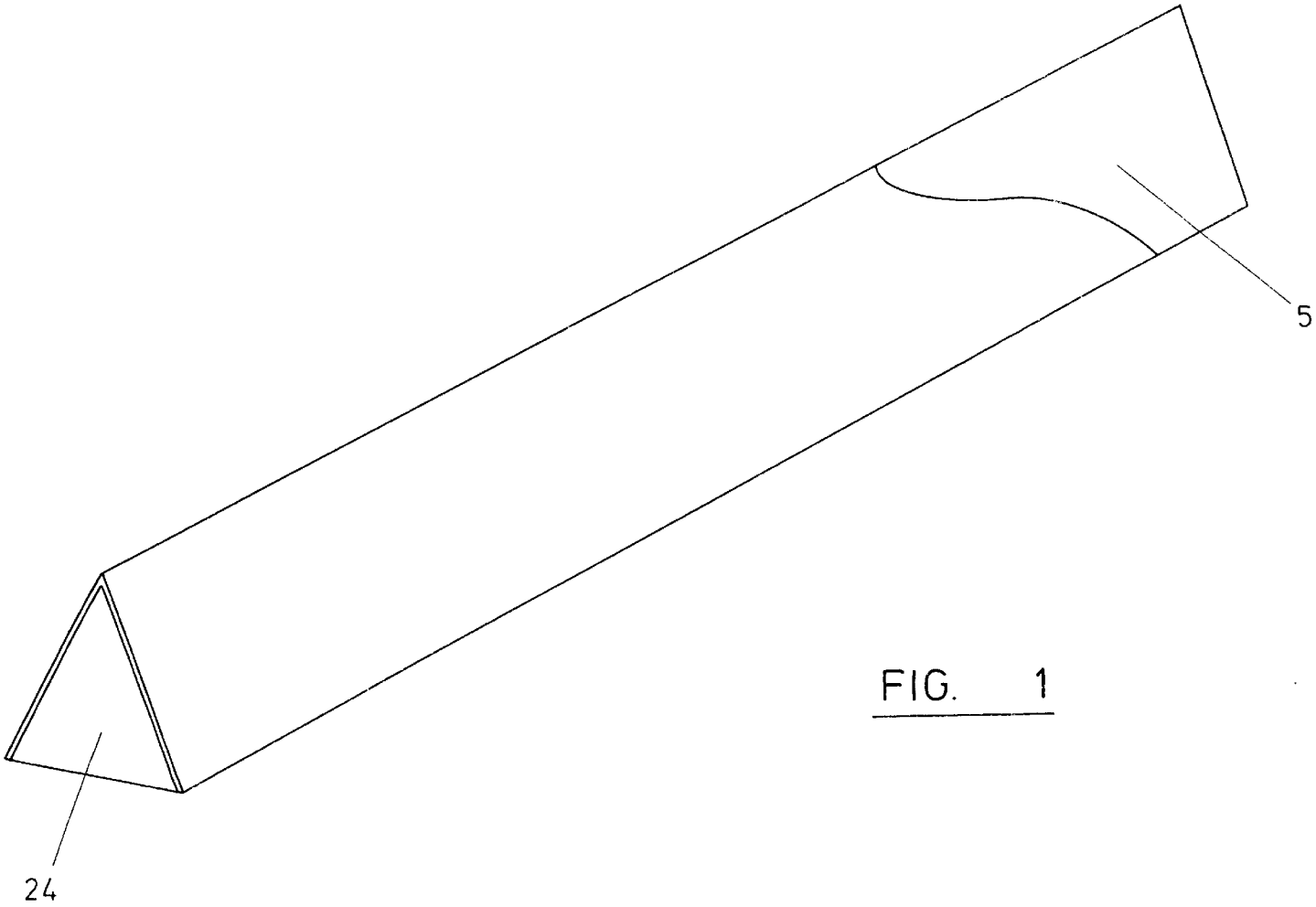
FIG. 1 is an isometric view of a first embodiment of carton or pack in accordance with this invention.
Figure 2:
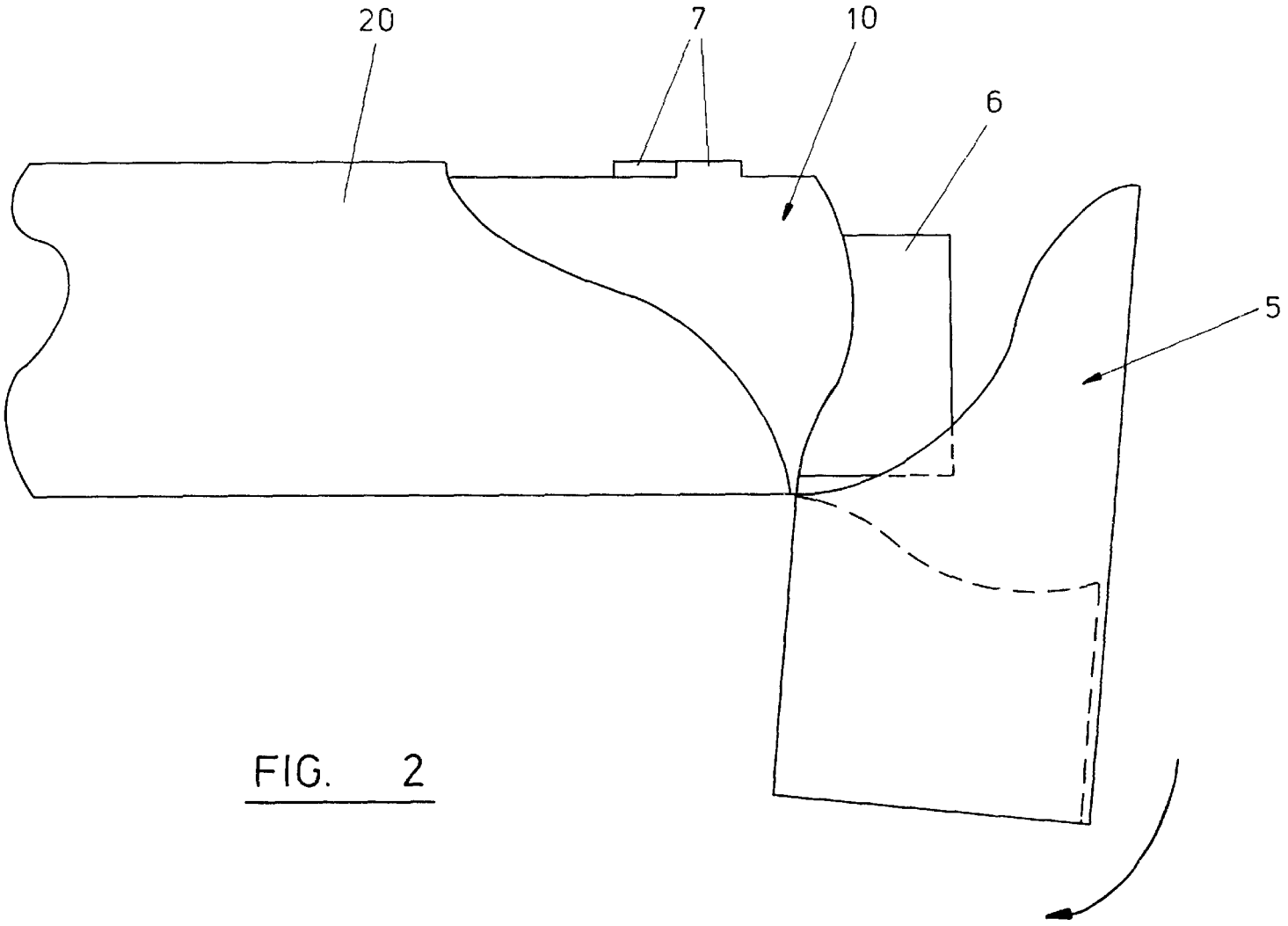
FIG. 2 is a side view, on enlarged scale, of one end portion of the carton of FIG. 1.

Referring to FIGS. 1 and 2 of the drawings, there is shown a tubular carton or pack which is formed from a one-piece blank of card or other sheet material, and is triangular in cross-section. The example shown is relatively long and small in cross-section, suiting it to receive a rolled up paper product such as a map or drawings, but in general the carton can be made to any required size or ratio of length to cross-section, for accommodating any desired product or products. In addition, the carton may be tapered towards one end for certain packaging requirements.

The two extreme ends of the carton are closed, but at one end the carton has a relatively short portion 5 which is arranged to hinge open, as shown in FIG. 2, along a fold line extending across the base of the carton, enabling easy access to the product (in this case a rolled-up map or drawing 6) which is stored within the carton. It will be noted that the carton comprises an outer shell 20 and an inner lining 10, with the inner lining 10 projecting beyond the end of the main part of the outer shell 20: when the end portion 5 of the carton is hinged into the closed position, the inner surfaces of the two sides of the end portion frictionally engage the two sides of the projecting portion of the inner lining 10, to hold the end portion 5 of the carton in the closed position. In order to assist this, two tabs 7 are formed from the inner lining, and project at the apex opposite the hinged base of the carton, to frictionally engage the inner surfaces of the hinged end portion 5: instead, other elements may be pressed or bent out of the end portion 5 and/or the projecting portion of the inner lining 10, to interengage when the end portion 5 of the carton is closed.

Figure 3:
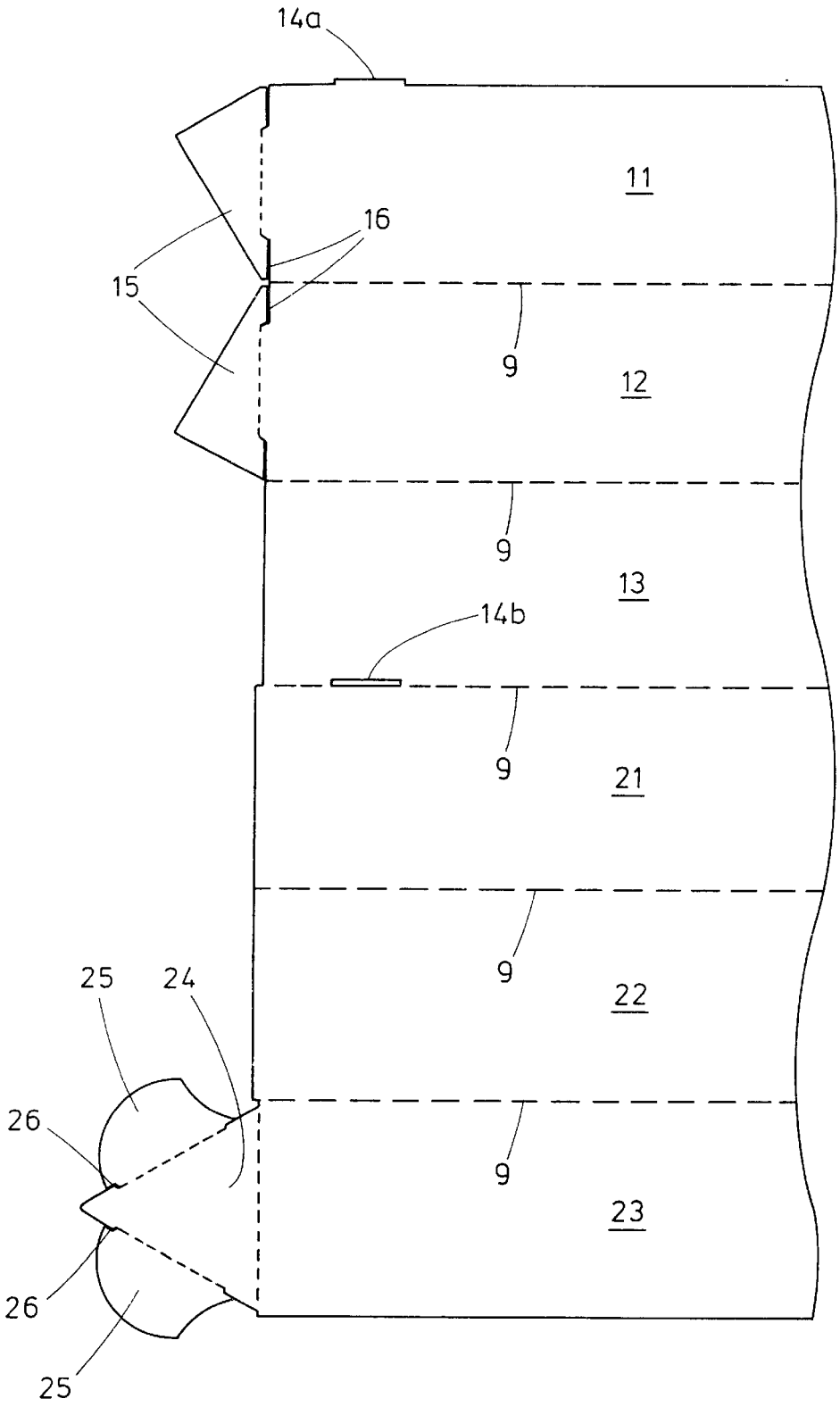
FIG. 3 is a plan view of an end of a one-piece blank from which the carton of FIGS. 1 and 2 is formed.
Figure 4:
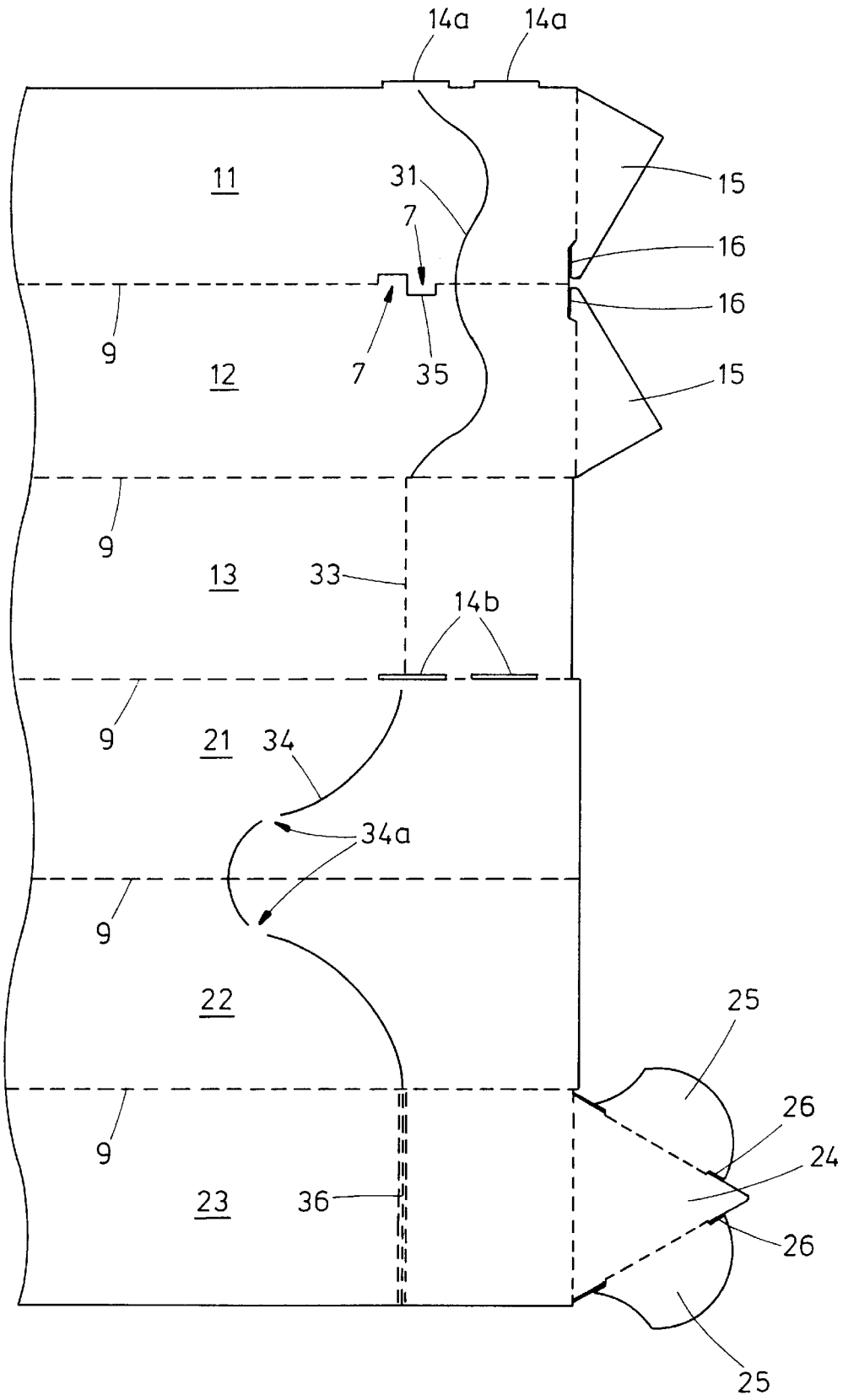
FIG. 4 is a plan view of the opposite end of the blank from which the carton of FIGS. 1 and 2 is formed.
Figure 4A:
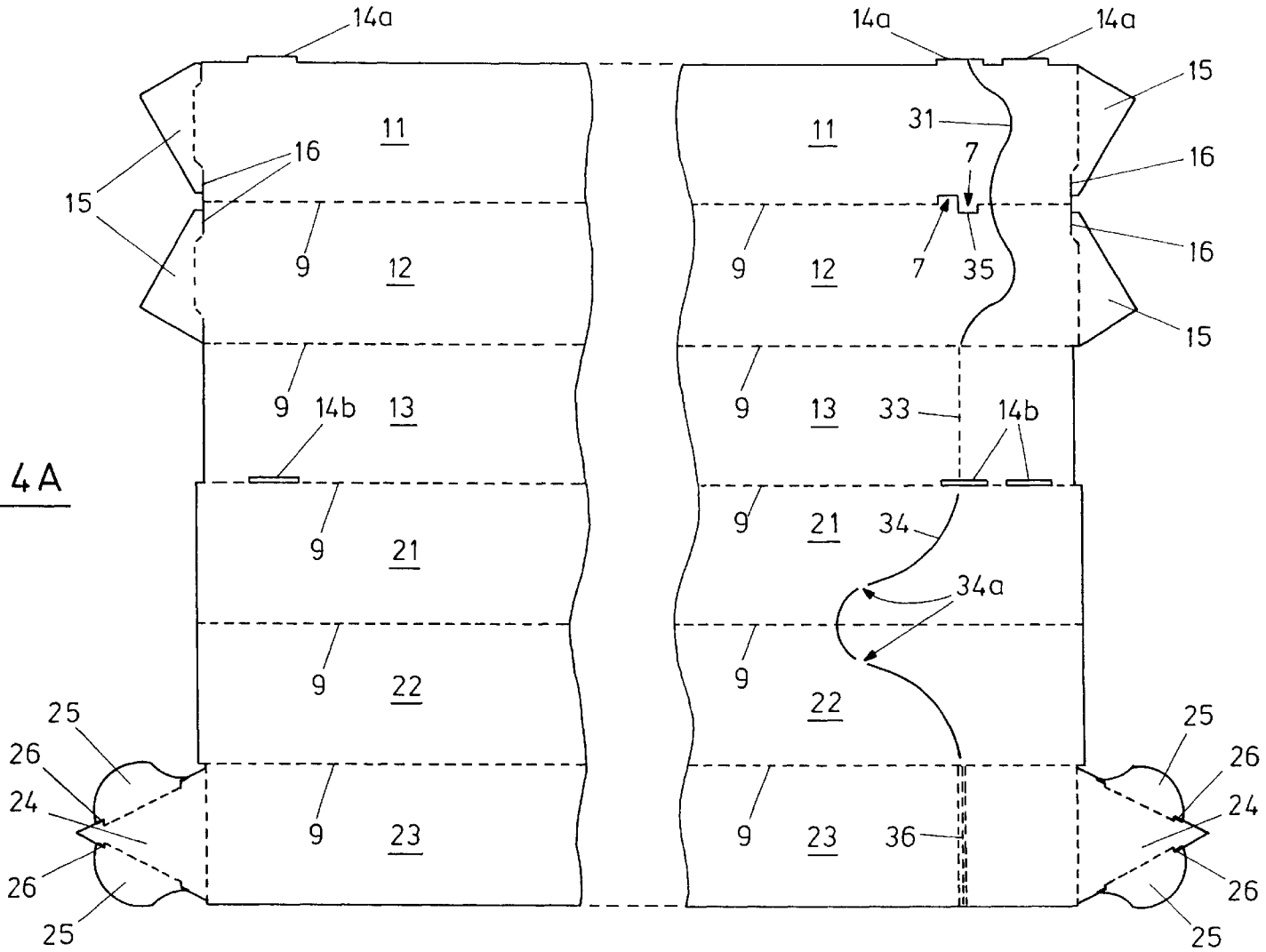
FIG. 4A is a plan view of a complete one-piece blank, comprised of the portions thereof illustrated in FIGS. 3 and 4, from which the carton of FIGS. 1 and 2 is formed.
Figure 5:
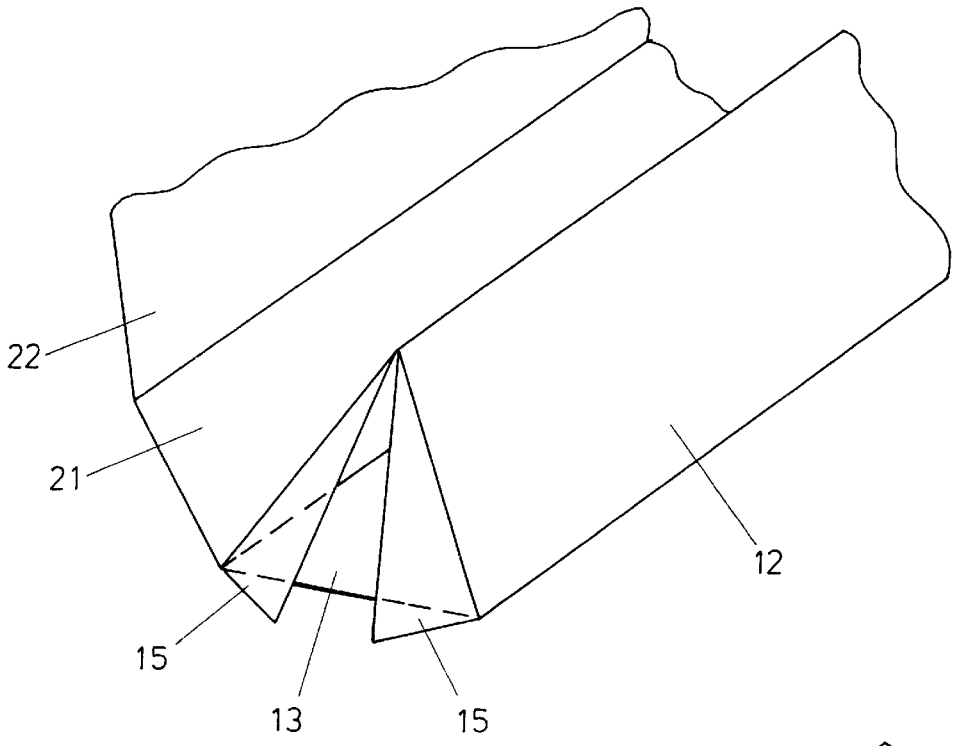
FIG. 5 is a perspective view showing an end of the carton after the blank of FIGS. 3 and 4 has been partly folded over.

The construction of the carton will now be explained in more detail with reference to FIGS. 3 to 6 of the drawings. FIGS. 3, 4 and 4A show a one-piece blank, cut from card or other sheet material, from which the carton is formed. The blank is divided, in the example shown, by parallel fold lines 9 into six rectangular panels 11,12,13 and 21,22,23. In constructing the carton from the blank, firstly the first three panels 11,12,13 are folded over to form the triangular inner lining 10, tabs 14*a* being provided on the edge of the first panel to locate in slots 14*b* along the fold line between the third and fourth panels: the configuration shown in FIG. 5 is thus achieved. Then the remaining three panels 21,22,23 are folded around the inner lining 10 to form the outer shell 20 of the carton, the configuration then being as shown in FIG. 6.

Figure 6:
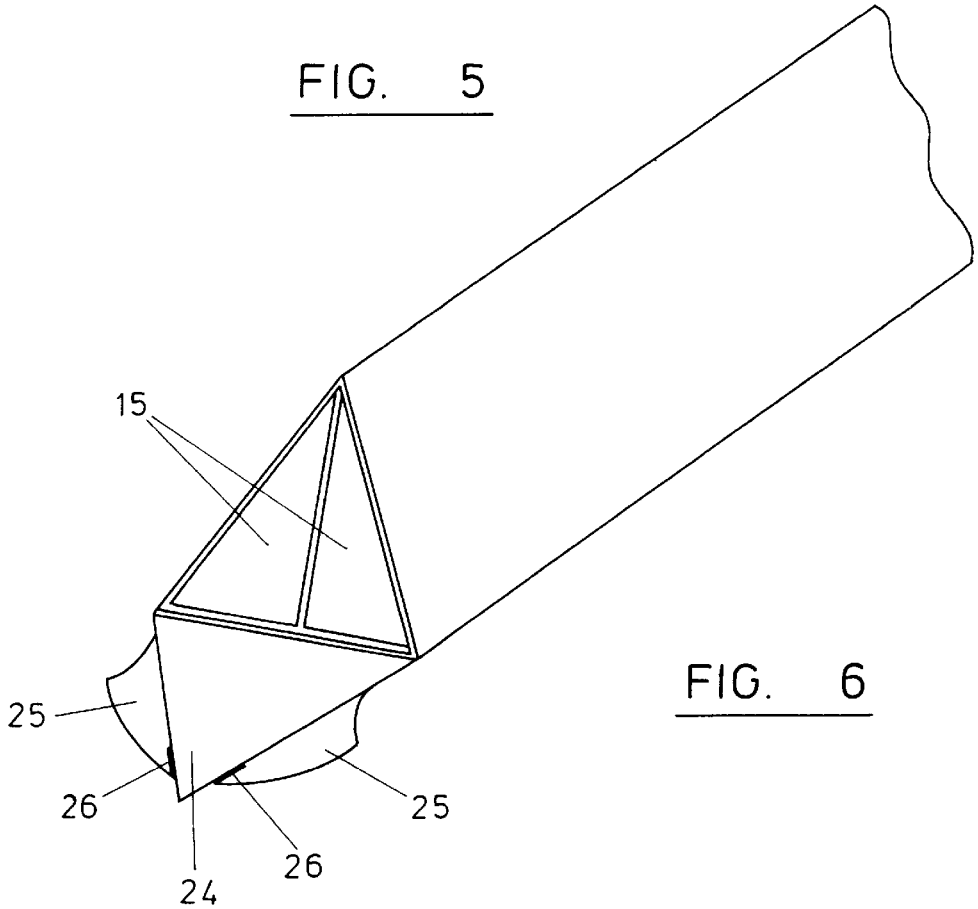
FIG. 6 is a similar view showing the same end of the carton after the blank has been fully folded but before its respective end piece has been closed across the end of the carton.

At each end of the blank, triangular closure flaps 15 project from the ends of the first two panels 11,12 and are folded across the end of the inner lining 10 to close the latter as shown in FIG. 6. Also at each end of the blank, a triangular end piece 24 projects from the end of the final panel 23: retainer flaps 25 project from the sides of each triangular end piece 24. Referring to FIG. 6, once the outer shell 20 has been folded around the inner lining 10 and the closure flaps 15 have been folded across the end of the inner lining 10, the triangular end piece 24 is folded over the pair of closure flaps 15 and, in so doing, its retainer flaps 25 are inserted between the inner lining 10 and outer shell 20, at respective sides of the carton. Short slits 16 are formed along the hinge lines of closure flaps 15, so that the adjacent portion of each flap 15 forms a small tab which engages in a similar slit 26 formed along the hinge line of the respective retainer flap 25 when the latter is inserted between the inner lining 10 and outer shell 20 of the carton, so locking the triangular end piece 24 in its closed position (shown in FIG. 1).

It will be noted that, at each end of the blank shown in FIGS. 3, 4 and 4A, the fold lines between the first two panels 11,12 and their closure flaps 15, and also the end edge of the third panel 13, are all slightly inset from the end edges of the fourth and fifth panels 21,22. Accordingly, the end of the inner lining 10, which is formed by the first three panels 11,12,13, is slightly inset from the end of the outer shell 20, as defined by its two side panels 21 and 22: the fold line between the final panel 23 and the triangular end piece 24 is also slightly inset from the end edge of the panels 21 and 22, so that when the end piece 24 is folded across the end of the carton, its outer surface lies flush with the end of the outer shell 20.

Referring to FIG. 4, fold lines 33 and 36 are formed across the third and final panels 13 and 23, which correspond, respectively, to the base of the inner lining 10 and the base of the outer shell 20: the fold lines 33,36 coincide when the blank is fully folded up, to form the hinge between the main length of the carton and its openable end portion 5 (FIGS. 1 and 2). The blank is cut along two lines 31,34: lines 31 forms a division, in the two sides of the inner lining 10, between the main length of the carton and its openable end portion 5; the other line 34 forms a division, in the two sides of the outer shell 20, between the main length of the carton and its openable end portion 5. Line 31 has its opposite ends aligned with the fold lines 33,36, but follows a path lying closer than these fold lines to the adjacent end of the blank, the path being symmetrical about the fold between the first and second panels 11,12. Accordingly, and as shown in FIG. 2, the end of the inner lining 10 curves away from the hinge line and then curves back towards the apex opposite the hinged base. Line 34 also has its opposite ends aligned with the fold lines 33,36 but follows a path lying further than these fold lines from the end of the blank, the path being symmetrical about the fold between the fourth and fifth panels 21,22 of the blank. Accordingly, and as shown in FIGS. 1 and 2, the end of the main length of the outer shell 20 of the carton follows a line which is inclined, from the hinge line to the apex opposite the hinged base, away from the adjacent end of the carton. Whilst in the example shown this line follows a particular curved line, it may in general follow alternative profiles; for example, it may follow a straight line.

Also in FIG. 4, it will be noted that one of the tabs 14*a* extends across the end of the cut line 31, and this cut line does not extend through the tab: accordingly, this tab 30 holds the main and end portions of the panel 11 together as panels 11,12 and 13 are folded over to form the inner lining 10. A line 35 is cut at the fold line 9 between panels 11 and 12, to form the tabs 7 which project from the apex of the inner lining 10, as shown in FIG. 2, for frictional engagement with the end portion 5 of the carton. Preferably as shown in FIG. 4, as a security feature the cut line 34 is interrupted e.g. at 34*a*, so that when the blank is folded up to form the carton, the end portion 5 is retained in its closed position until, by a slight snapping motion to open the end portion 5, the outer shell is torn across these interruptions.

Figure 7:
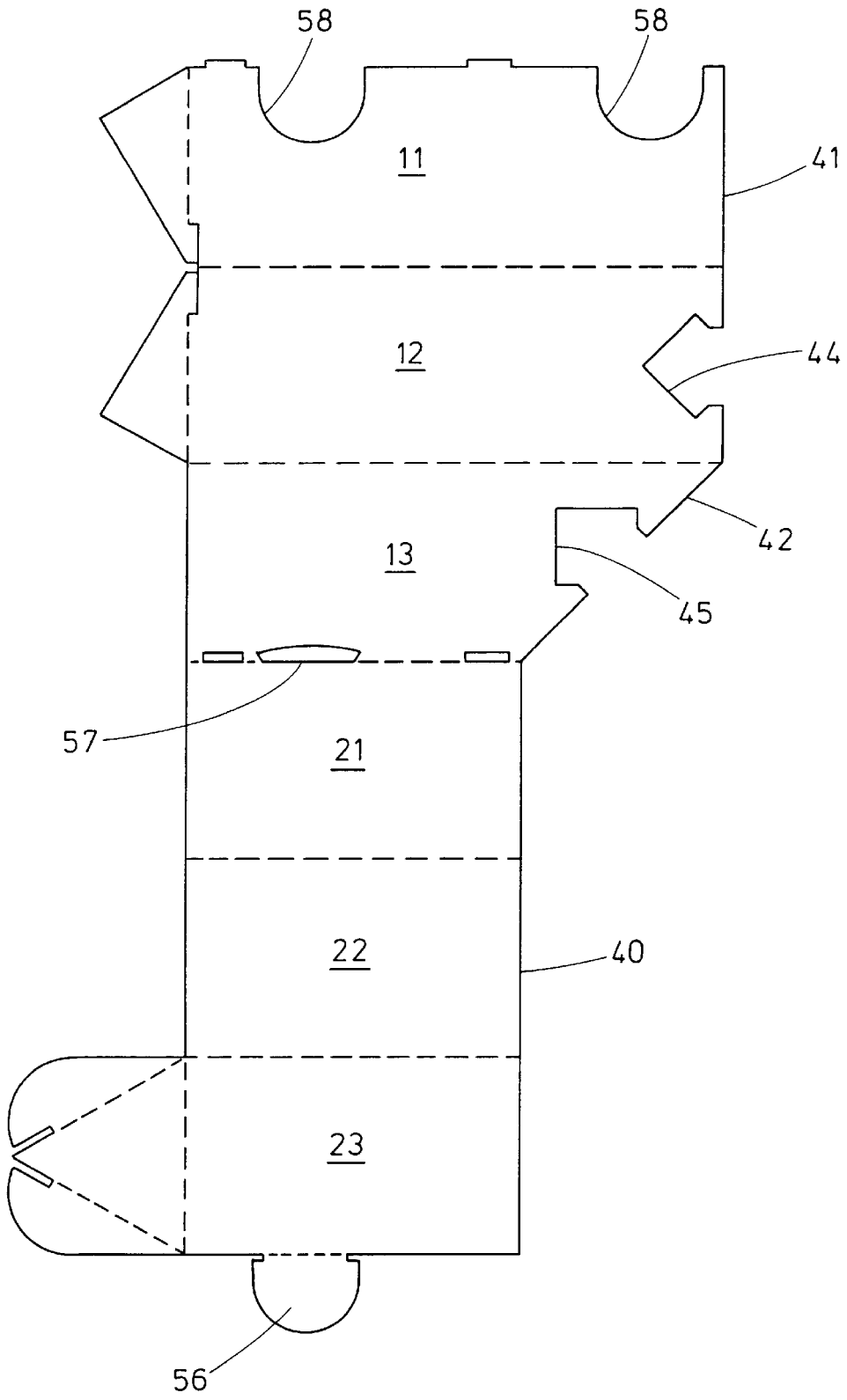
FIG. 7 is a plan view of one piece of a blank, to form one end of a second embodiment of carton.
Figure 8:
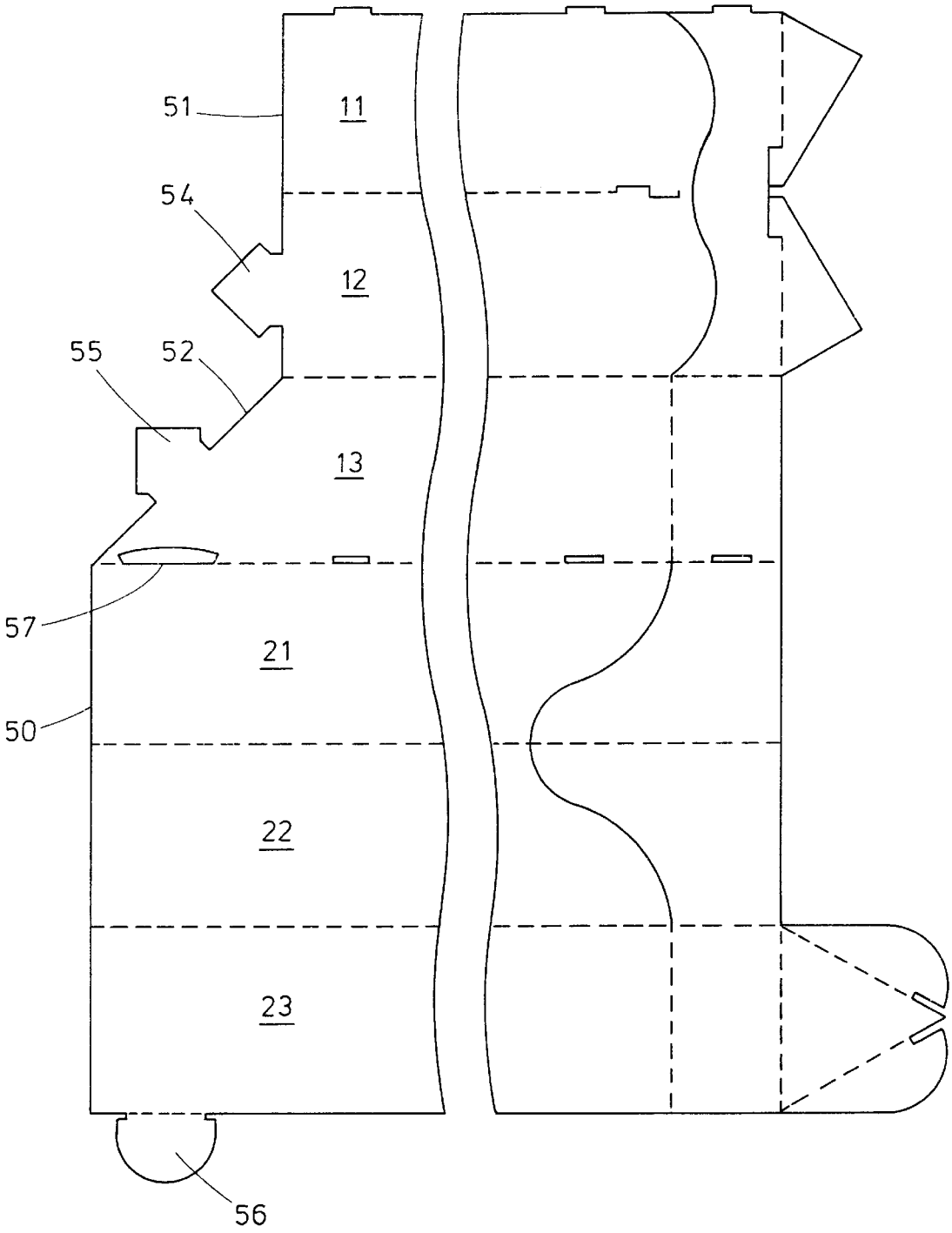
FIG. 8 is a plan view of a second piece of a blank, to form the opposite end of the second embodiment of carton.
Figure 9:
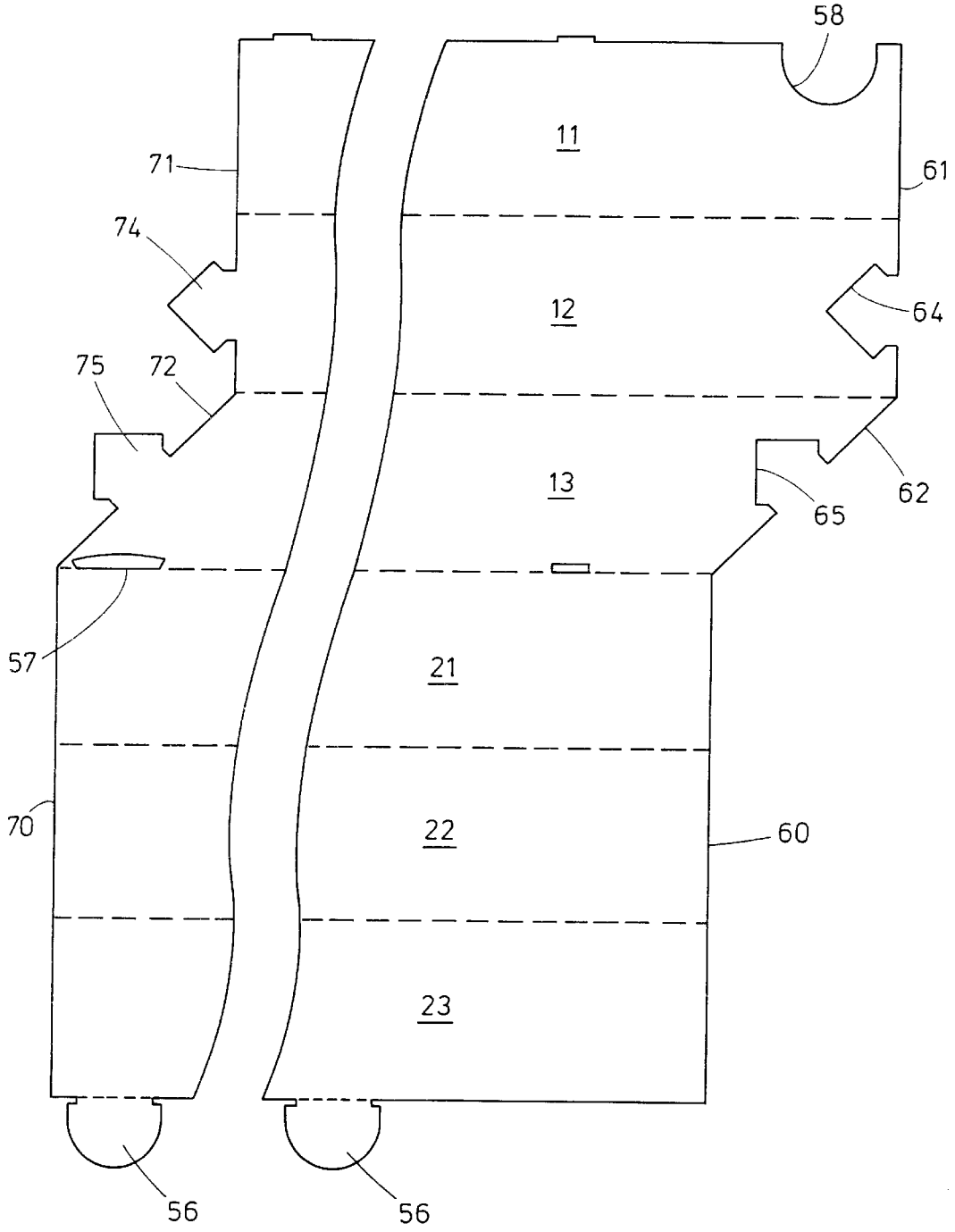
FIG. 9 is a plan view of an extension piece to form an extension of the second embodiment of carton.

As previously mentioned, there are occasions in which it is desirable to form a carton of selected or extended length. FIGS. 7 to 9 show separate pieces for forming a carton of modular construction, to a selected length. Thus, FIGS. 7 and 8 show pieces for forming the two opposite ends of a carton blank: in essence, the blank differs from the one-piece blank of FIGS. 3 and 4 in that it comprises two or more pieces to be joined together end-to-end before folding up the blank to form the carton. However, if a carton of extended length is required, then the pieces of FIGS. 7 and 8 are joined to opposite ends of the extension piece shown in FIG. 9: it will be appreciated that two or more of these extension pieces may be joined end-to-end and then the respective end pieces of FIGS. 8 and 9 are joined on.

The end piece of FIG. 7 has a join edge 40 extending straight across the panels 21,22,23 and a join edge 41 extending straight across the panels 11,12 but further from the end edge of the piece than the join edge 40: join edges 40,41 are interconnected by an inclined join edge 42 across the panel 13. The opposite end piece of FIG. 8 has complementary join edges 50,51,52. Tabs 54,55 project from the join edges 51,52 of the end piece of FIG. 8, and are arranged to engage in complementary cut-outs 44,45 formed in the join edges 41,42 of the end piece of FIG. 7.

Thus, the opposite end pieces of FIGS. 7 to 8 can be joined, to form the carton blank, by bringing their respective join edges 40,41,42 and 50,51,52 into alignment and engaging the tabs 54,55 into the cut-outs 44,45. The carton blank can then be folded up in the manner described with reference to FIGS. 5 and 6: it will be appreciated that the panels 21,22,23 of the end piece of FIG. 7 will overlie the join between the respective portions of the inner-shell panels 10,11,12, and so prevent disengagement of the tabs 54,55 from their cut-outs 44,45. The outer edge of the final panel 23 is provided with projecting tabs 56 which are arranged to be passed through slots 57 in the fold line between the panels 13,21, to hold the outer edge of the panel 23 flat: the tabs 56 locate in complementary-shaped cut-outs 58 in the free edge of the panel 11, so as to lie flat within the wall thickness of the inner shell.

It will be noted that the extension piece of FIG. 9 has, at one end, a join edge 60,61,62 and cut-outs 64,65 corresponding to the join edge 40,41,42 and cut-outs 44,45 of the end piece of FIG. 7: at its other end, the extension piece of FIG. 9 has a join edge 70,71,72 and tabs 74,75 corresponding to the join edge 50,51,52 and tabs 54,55 of the end piece of FIG. 8. Thus, the extension piece of FIG. 9 may have the end piece of FIG. 8 joined to its first end and the end piece of FIG. 7 joined to its other end.

While this invention has been described in terms of a tubular carton or pack of equal triangular cross-section along the entire length thereof, it will be appreciated that the carton may be tapered such that one end thereof is wider than its opposite end. Alternatively one end of the carton may be tapered to a point. Preferably the wider end is the end which is arranged to open.

I claim:

1. A carton of triangular cross-section, said carton comprising a blank of sheet material provided with a series of folds dividing said blank into a plurality of panels, said blank being folded-up along successive said folds, so that a triangular-section inner lining is formed from three of said plurality of panels and a triangular-section outer shell is formed around said inner lining from an additional three of said plurality of panels, the carton having a first end and a second end, said second end being opposite said first end, and further comprising a base and two sides, the two sides of said inner lining and said outer shell being divided intermediate said first end and said second end of the carton or pack for forming the carton or pack into a main portion and an end portion, said end portion of the carton or pack being openable, relative to said main portion of the carton or pack, by flexing about a hinging fold line extending across said base at a position intermediate said first end and said second end of the carton, said main portion and said end portions having respective inner ends adjacent said fold and engaging together upon closure of said end portion relative to said main portion, the two sides of said inner lining being divided along respective first division lines and the two sides of said outer shell being divided along respective second division lines, said first division lines being non-coincident with said second division lines, so that said inner lining projects outwards beyond the outer shell at the inner end of one of said portions of the carton or pack and the outer shell of remaining said portions engages over the projecting said inner lining of the one said portions upon closing said end portion.

2. A carton as claimed in claim 1, further comprising a longitudinal apex formed between said two sides of the carton or pack and opposite side base, and said respective second division lines extend from said hinging fold line to said longitudinal apex in a direction inclined away from the inner end of said one portion.

3. A carton as claimed in claim 1, wherein one of said panels of said outer shell has a triangular end piece projecting therefrom, said triangular end piece closing one of said first end and said second end of the carton or pack, said triangular end piece having retainer flaps being inserted and frictionally engaged between respective over-lapping panels of said inner lining and said outer shell.

4. A carton as claimed in claim 3, wherein said inner lining has closure flaps hinged to respective panels thereof and folded across said one of said first end and said second end of the carton or pack for closing the latter, said triangular end piece being closed over said closure flaps.

5. A carton as claimed in claim 1, wherein said fold lines of said blank are parallel and said plurality of panels of said inner lining and said outer shell are rectangular.

6. A carton as claimed in claim 1, wherein said plurality of panels of said inner lining and said outer shell taper towards one end of said blank.

7. A carton as claimed in claim 1, wherein said blank is formed with projecting tabs on a free edge of a first panel of said plurality of panels of said inner lining and slots positioned along a fold line between a panel of said inner lining and a panel of said outer shell, said projecting tabs being located in respective said slots.

8. A carton as claimed in claim 1, wherein said blank is formed with retention tabs on a free edge of a final panel of said outer shell and with retention slots positioned in a fold line between two other panels of said blank, said retention tabs being inserted into respective said retention slots for retaining said outer shell closed around said inner lining.

9. A carton as claimed in claim 1, wherein said blank comprises one piece of sheet material.

10. A carton as claimed in claim 1, wherein said blank comprises at least two pieces of sheet material, said two pieces having respective end edges which are complimentary in shape to each other, said two pieces being joined together via respective said end edges thereof for extending the length of the carton or pack between its said first end and said second end.

11. A carton as claimed in claim 10, wherein said respective end edges of said two pieces of sheet material are formed with complementary, inter-engaged coupling tabs and cut-outs for coupling said two pieces together.

12. A carton as claimed in claim 11, wherein said coupling tabs and cut-outs are formed in panels of said inner lining and said end edges comprise first sections extending across, at least, a portion of said panels of said inner lining and second sections extending across, at least, a portion of said panels of said outer shell, said first sections and said second sections being offset from each other, so that said panels of said outer shell of one said piece of sheet material overlie said first sections of said end edges.

* * * * *